US009884497B2

(12) United States Patent
Mark et al.

(10) Patent No.: US 9,884,497 B2
(45) Date of Patent: Feb. 6, 2018

(54) CORRUGATED-BOARD MACHINE

(71) Applicant: BHS Corrugated Maschinen-und Anlagenbau GmbH, Weiherhammer (DE)

(72) Inventors: Maximilian Mark, Tirschenreuth (DE); Alfons Gnan, Vilseck (DE); Norbert Städele, Parkstein (DE)

(73) Assignee: BHS Corrugated Maschinen-und Anlagenbau GmbH, Weiherhammer (DE)

( * ) Notice: Subject to any disclaimer, the term of this patent is extended or adjusted under 35 U.S.C. 154(b) by 0 days.

(21) Appl. No.: 15/272,834

(22) Filed: Sep. 22, 2016

(65) Prior Publication Data

US 2017/0087900 A1 Mar. 30, 2017

(30) Foreign Application Priority Data

Sep. 24, 2015 (DE) ..... 10 2015 218 333

(51) Int. Cl.
*B41J 15/04* (2006.01)
*B31F 1/28* (2006.01)

(52) U.S. Cl.
CPC ..... *B41J 15/04* (2013.01); *B31F 1/2822* (2013.01)

(58) Field of Classification Search
CPC ..... B31F 5/00; B31F 2201/0782; B31F 2201/0792; B31F 1/2822; B32B 39/00; B41J 2/0015; B41J 15/04
See application file for complete search history.

(56) References Cited

U.S. PATENT DOCUMENTS 5,117,610 A * 6/1992 Hartman ..... B41F 17/02 101/490
5,772,819 A 6/1998 Olvey
2006/0148631 A1* 7/2006 Protocsnak ..... B31F 1/2822 493/463

(Continued)

FOREIGN PATENT DOCUMENTS

DE 19 24 265 A1 12/1969
DE 41 18 969 C1 7/1992
DE 10 2005 060 216 A1 6/2007

(Continued)

*Primary Examiner* — Huan Tran
*Assistant Examiner* — Alexander D Shenderov
(74) *Attorney, Agent, or Firm* — McGlew and Tuttle, P.C.

(57) ABSTRACT

The invention relates to corrugated-board machine with a print-web printing line, which comprises a print-web unrolling device for the unrolling of a print-web and a printing device for printing the print-web. Furthermore, the corrugated-board machine has a corrugated-board manufacturing line with a cover-web unrolling device for the unrolling of a cover-web, a material-web unrolling device for the unrolling of a material-web to be corrugated, a device for manufacturing a corrugated-board web laminated on one side from the cover-web and the material-web, a lamination-web unrolling device for the unrolling of a lamination-web and a gluing unit for applying glue to the corrugated-board web laminated on one side. The corrugated-board machine further comprises a print-web transfer arrangement for transferring the print-web to the corrugated-board manufacturing line and for the use of the same as a lamination-web.

20 Claims, 7 Drawing Sheets

(56) References Cited

U.S. PATENT DOCUMENTS

2006/0237120 A1* 10/2006 Mattila ..... B31F 1/2809
156/205

FOREIGN PATENT DOCUMENTS

| | | | |
|---|---|---|---|
| DE | 10 2006 015 267 | A1 | 10/2007 |
| EP | 0 518 053 | B1 | 1/1995 |
| GB | 1204986 | A | 9/1970 |
| JP | S59 52655 | A | 3/1984 |

* cited by examiner

CORRUGATED-BOARD MACHINE

CROSS-REFERENCE TO RELATED APPLICATIONS

This application claims the priority of German Patent Application Serial No. DE 10 2015 218 333.5, filed on Sep. 24, 2015, pursuant to 35 U.S.C. 119(a)-(d), the content of which is incorporated herein by reference in its entirety as if fully set forth herein.

FIELD OF THE INVENTION

The invention relates to a corrugated-board machine with a corrugated-board manufacturing line for manufacturing a corrugated-board web or respectively corrugated board.

BACKGROUND OF THE INVENTION

Corrugated-board machines are known generally from the prior art through prior public use. The prior art also discloses corrugated-board machines with integrated printing devices for printing a lamination-web of the corrugated-board web. The disadvantage with these known corrugated-board machines is that often, as a whole, they are of an enormous length. Especially downstream of a lamination-web unrolling device, a considerable space requirement is generally necessary for the accommodation of the printing device. Furthermore, the printing quality of such corrugated-board machines is often unsatisfactory.

SUMMARY OF THE INVENTION

The invention is therefore based upon the object of providing a corrugated-board machine comprising a printing device, which comprises a comparatively short length. Furthermore, the print quality of the corrugated-board machine should be particularly high.

This object is achieved according to the invention by a corrugated-board machine, with a print-web printing line for manufacturing a printed print-web, comprising a print-web unrolling device for unrolling a print-web to be printed, and a printing device for printing the print-web, a corrugated-board manufacturing line for manufacturing a corrugated-board web, comprising a cover-web unrolling device for unrolling a cover-web, a material-web unrolling device for unrolling a material-web to be corrugated, a device for manufacturing a corrugated-board web laminated on one side made from the cover-web and the material web, a lamination-web unrolling device for unrolling a lamination-web, and a gluing-unit for applying glue to the corrugated-board web laminated on one side, and a print-web transfer arrangement disposed downstream of the print-web printing line and adjoining the corrugated-board manufacturing line for transferring the print-web to the corrugated-board manufacturing line and using as a laminated web. The core idea is that the print-web printing line is connected to the corrugated-board manufacturing line via the print-web transfer arrangement. The corrugated-board web laminated on one side can be connected, for example, to the lamination-web of the corrugated-board manufacturing line or the print-web, especially with glue. The corrugated-board web manufactured by the corrugated-board machine can comprise on the outer side the lamination-web of the corrugated-board manufacturing line or the print-web of the print-web printing line, which then forms the lamination-web.

The corrugated-board manufacturing line favourably has a connecting device for connecting the corrugated-board web laminated on one side with the lamination-web, which is formed from the print-web from the print-web printing line or from the lamination-web from the corrugated-board manufacturing line. The connecting device is preferably constituted as a double facer or respectively a hot-pressing device.

It is advantageous if the print-web printing line comprises at least one conveying unit for conveying the print-web.

The print-web printing line favourably has a pre-coating unit for pre-coating the print-web to be printed.

It is expedient if the print-web printing line comprises a corona pre-treatment unit for the pre-treatment of the print-web to be printed.

The print-web printing line favourably has a varnishing device for the overcoating of the printed print-web or respectively its at least one printed region.

It is advantageous if the print-web printing line comprises at least one drying device for drying the print-web. A drying of the pre-coating, the at least one imprint and/or the varnish is favourably implemented.

In this context, the printing device is advantageously a digital printing device, especially an inkjet printing unit. Other known printing devices can be used as an alternative. Setting up a print-web printing line, in which a digital printing device is integrated, adjacent to the corrugated-board machine is very advantageous because the digital printing device comprises a sensitive behaviour with reference to environmental heat, vibrations and the occurrence of dust. The accessibility of the digital printing unit, for example, for the cleaning of components, is additionally substantially improved.

The printing device is, in particular, able to imprint at least a letter, a number, another character, a graphic and/or a photograph on the print-web. For this purpose, colour or respectively ink is favourably used. The print-web preferably is or respectively remains a smooth, un-corrugated web.

In a favourable manner, the finished corrugated-board web is a three-layered corrugated-board web. As an alternative, the latter comprises more than three, especially five or seven layers.

It is advantageous if the cover-web unrolling device is constituted as a splicing device for the provision of an endless cover-web.

The material-web unrolling device is favourably constituted as a splicing device for the provision of an endless material web.

The device for manufacturing a corrugated-board web laminated on one side preferably comprises a corrugation unit for corrugating the material web to be corrugated thereby forming a corrugated web.

The lamination-web unrolling device is favourably constituted as a splicing device for the provision of an endless lamination-web.

It is advantageous if the device for manufacturing a corrugated-board web laminated on one side comprises a glue-application unit for the gluing of the corrugated web.

It is expedient if the device for manufacturing a corrugated-board web laminated on one side further comprises a pressing unit for pressing the cover-web against the corrugated web provided with glue.

The gluing unit preferably has a glue-application roller for applying glue from a glue container onto the corrugated-board web laminated on one side or respectively its corrugated web.

The terms "upstream", "downstream", "disposed downstream", "disposed upstream" or similar used here relate, in particular, to the respective conveyed web.

The arrangement of the print-web printing line and the corrugated-board manufacturing line such that they extend at least in regions parallel and laterally offset relative to one another leads to a corrugated-board machine which has a comparatively short length. The print-web printing line and the corrugated-board manufacturing line are arranged in web-conveying direction side-by-side or respectively parallel to one another. In general, this allows a simple replacement of a conventional corrugated-board machine with the corrugated-board machine according to the invention, because sufficient space is often still available at the side of the corrugated-board manufacturing line. A simple retrofitting of an existing corrugated-board machine is further guaranteed.

The print-web printing line favourably extends, especially over its entire length, adjacently alongside the corrugated-board manufacturing line. The deliberations regarding the embodiment in which the print-web printing line and the corrugated-board manufacturing line extend at least in regions parallel and laterally offset relative to one another apply here substantially by analogy.

It is advantageous if the print-web printing line extends adjacent to the laminate unrolling device, the glue unit and/or a pre-heating arrangement for the pre-heating at least of the corrugated-board web laminated on one side. This is a preferred arrangement of the print-web printing line relative to the corrugated-board manufacturing line.

The storage device for storing the corrugated-board web laminated on one side, said storage device being arranged downstream from the device for manufacturing a corrugated-board web laminated on one side, allows a simple intermediate storage and buffering of the corrugated-board web laminated on one side. For this purpose, the corrugated-board web laminated on one side favourably forms at least one loop, by greater preference several loops, in the storage device.

Through the arrangement in which the print-web transfer arrangement is connected adjacent to the storage device to the corrugated-board manufacturing line, vibrations in the glue unit or respectively a double facer can be reduced.

In one embodiment, the print-web transfer arrangement is connected to the corrugated-board manufacturing line vertically above the material-web unrolling device. It is connected to the corrugated-board manufacturing line at a vertical height with a spacing distance from a substructure, base, such as warehouse floor, or similar. There, the print-web transfer arrangement does not stand in the way of a machine operator or similar. Works transport vehicles can also travel below this region in the case of a vertical height with sufficient spacing distance.

By comparison with the embodiment in which the print-web transfer arrangement is connected above the material-web unrolling device to the corrugated-board manufacturing line, the print-web transfer arrangement is connected to the corrugated-board manufacturing line relatively lower, namely at approximately a vertical height of a connecting and cutting unit of the material-web unrolling device to the corrugated-board manufacturing line. It is connected to the corrugated-board manufacturing line at a vertical height with a spacing distance from a substructure, base, such as warehouse floor, or similar.

Alternatively, the print-web transfer arrangement is connected to the corrugated-board manufacturing line adjacent to a substructure. It is advantageous if the print-web transfer arrangement extends adjacently above the substructure at least in regions. Alternatively, the latter extends in the substructure at least in regions.

In one embodiment, the print-web transfer arrangement favourably extends at least in regions substantially perpendicular to the corrugated-board manufacturing line. It is advantageous if the print-web transfer arrangement extends substantially in its entirety perpendicular to the corrugated-board manufacturing line. Alternatively, the print-web transfer arrangement extends diagonally to the corrugated-board manufacturing line.

The print-web transfer arrangement favourably extends at least in regions substantially perpendicular to the print-web printing line. It is expedient if the print-web transfer arrangement extends substantially in its entirety perpendicular to the print-web printing line. A diagonal arrangement of the print-web transfer arrangement relative to the print-web printing line is provided as an alternative.

The deflection arrangement for deflecting the print-web from its conveying direction into a conveying direction of the corrugated-board web at the print-web transfer arrangement, wherein the deflection arrangement preferably deflects the print-web through substantially 180°, is favourably constituted as a rail arrangement. The deflection arrangement is capable of deflecting the print-web during its conveying.

It is expedient if the print-web transfer arrangement comprises a first deflection unit for deflecting the print-web relative to the corrugated-board manufacturing line adjacent to the print-web printing line, wherein the first deflection unit preferably deflects the print-web substantially through 90°.

The first deflection unit is favourably constituted as a deflection rail, which is arranged diagonally to the print-web printing line or respectively to a conveying direction of the print-web present there. The deflection rail favourably encloses an angle of 45° to the print-web printing line or respectively to the conveying direction present there. The first deflection unit preferably turns the print-web through approximately 180°.

The print-web transfer arrangement preferably comprises a second deflection unit adjacent to the corrugated-board manufacturing line, for deflecting the print-web in the conveying direction of the corrugated-board web laminated on one side in the print-web transfer arrangement, wherein the second deflection unit preferably deflects the print-web substantially through 90°.

The second deflection unit is favourably constituted as a deflection rail, which is arranged diagonally to the print-web printing line or respectively to a conveying direction of the print-web in the print-web transfer arrangement. The second deflection rail is, furthermore, arranged diagonally to the corrugated-board manufacturing line or respectively to the conveying direction of the corrugated-board web in the print-web transfer arrangement. The second deflection rail is favourably arranged at an angle of 45° to the print-web transfer arrangement or respectively to the conveying direction of the print-web in the print-web transfer arrangement or respectively to the corrugated-board manufacturing line or respectively to the conveying direction of the corrugated-board web in the print-web transfer arrangement. The second deflection unit preferably turns the print-web through approximately 180°. The first deflection rail and the second deflection rail are favourably disposed in planes extending parallel to one another. Since printing units in digital printing processes favourably print a moving material web from above, and the lamination-web is glued with the printed side facing downwards with the one-sided corrugated-board web, the deflection rails are ideally looped around in such a manner that, at the same time, an appropriate turning of the print-web through the deflection unit takes place.

It is advantageous if the deflection rails are not looped around with the printed side of the print-web in order to avoid damaging the imprint.

Alternatively, the deflection rails can have an air flushing, so that damage to the imprint is not expected if it is looped on the printed side because of the reduced shear forces.

The print-web storage device, arranged downstream of the printing device, for storing the print-web favourably allows an intermediate storage or respectively buffering of the print-web. It is advantageous if the print-web storage device is capable, for example, of storing the print-web, when the print-web is not being used for the formation of the corrugated-board web, but the lamination-web from the corrugated-board manufacturing line is used. In this manner, the print-web can be stored in the print-web storage device.

According to one embodiment, the print-web storage device comprises a print-web winding-on unit for winding on the print-web. Such a print-web winding-on unit is capable of accommodating or respectively storing a very large quantity of print-web.

By comparison with the print-web winding-on unit, the dynamic print-web storage unit for storing the print-web has substantially smaller storage capacity for print-web. Dynamic changes in the unrolling speed of the print-web unrolling device can be favourably compensated particularly readily through the dynamic print-web storage unit.

The print-web distributing-guide arrangement for guiding the print-web to the print-web winding-on unit or to the corrugated-board manufacturing line, said print-web distributing-guide arrangement being arranged between the print-web winding on unit and the dynamic print-web storage unit, favourably allows a particularly flexible use of the print-web. For example, the print-web can be manufactured from stock and can preferably be stored by the print-web winding-on unit. Alternatively, the latter is guided simultaneously for further processing in the corrugated-board manufacturing line.

It is advantageous if the print-web unrolling device is constituted as a splicing device. This embodiment allows the manufacture of an endless print-web, which guarantees an interruption-free manufacture of the corrugated-board web with the print-web.

The embodiment in which the lamination-web unrolling device is constituted as a multiple-splicing device, which comprises a first splicing unit for splicing a first laminated web and a second laminated web to one another and a second splicing unit for splicing the print-web to the first laminated web or second laminated web guarantees a particularly functionally secure and simple introduction of the print-web into the corrugated-board manufacturing line. The first lamination-web and the second lamination-web can be spliced to one another by the first splicing unit. Expressed differently, the first lamination-web can be spliced to an endless lamination-web, or the second lamination-web to the endless lamination-web. The first print-web can be spliced by the second splicing unit to the first lamination-web or the second lamination-web. Expressed differently, the print-web can be spliced to the endless lamination-web.

In the following, two preferred embodiments of the invention are described by way of example with reference to the attached drawings.

DESCRIPTION OF THE PREFERRED EMBODIMENTS

Figure 1:
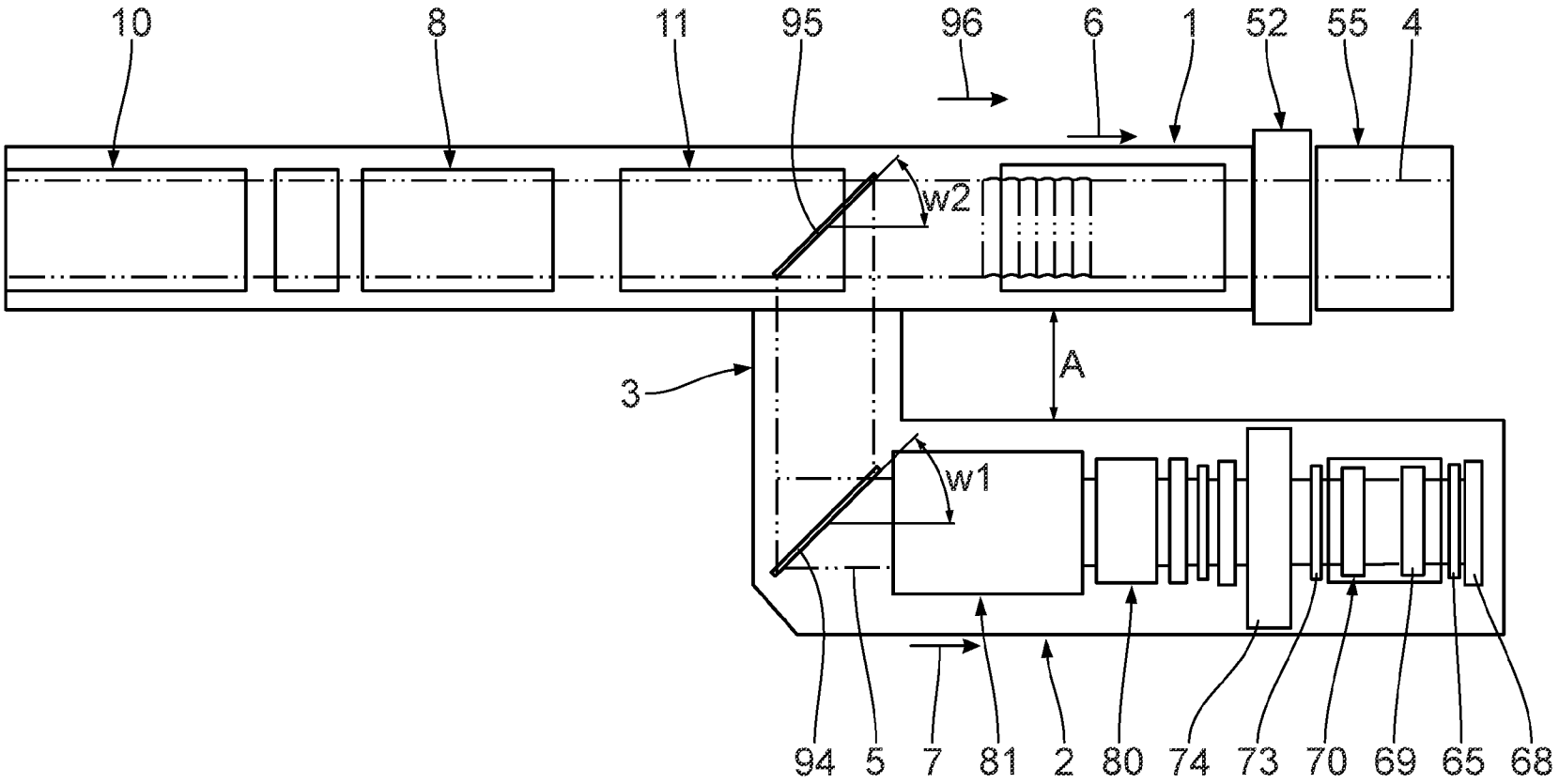
FIG. 1 shows a schematic plan view of a part of a corrugated-board machine according to the invention in a first embodiment.
Figure 2:
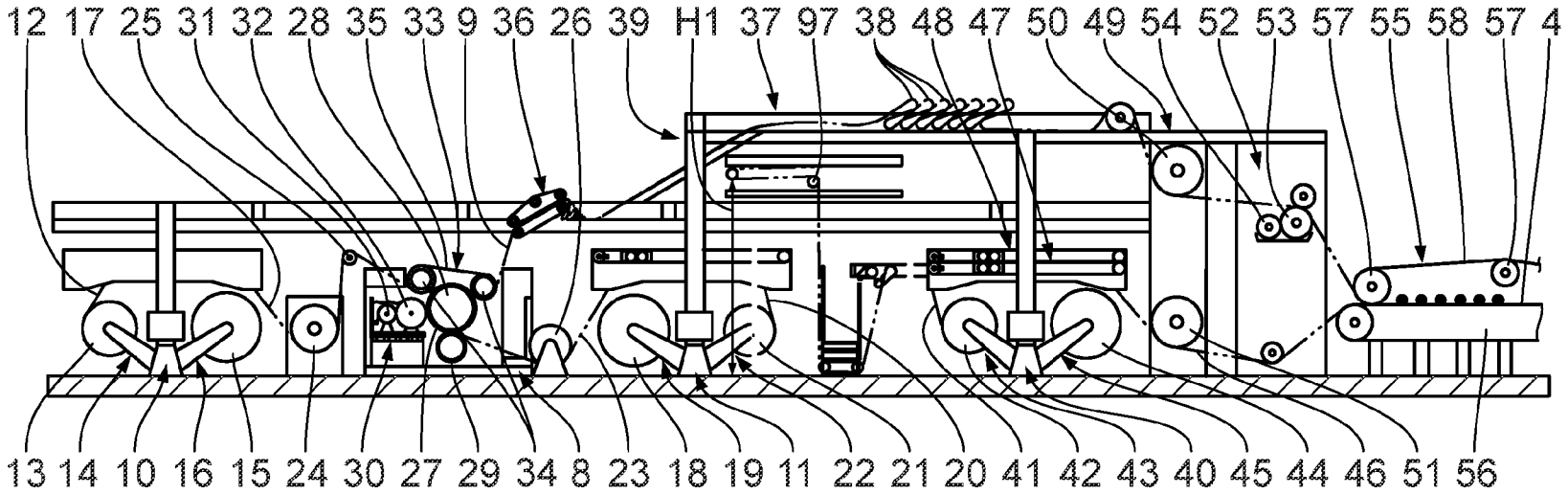
FIG. 2 shows a lateral view of the corrugated-board manufacturing line of the corrugated-board machine illustrated in FIG. 1.
Figure 3:
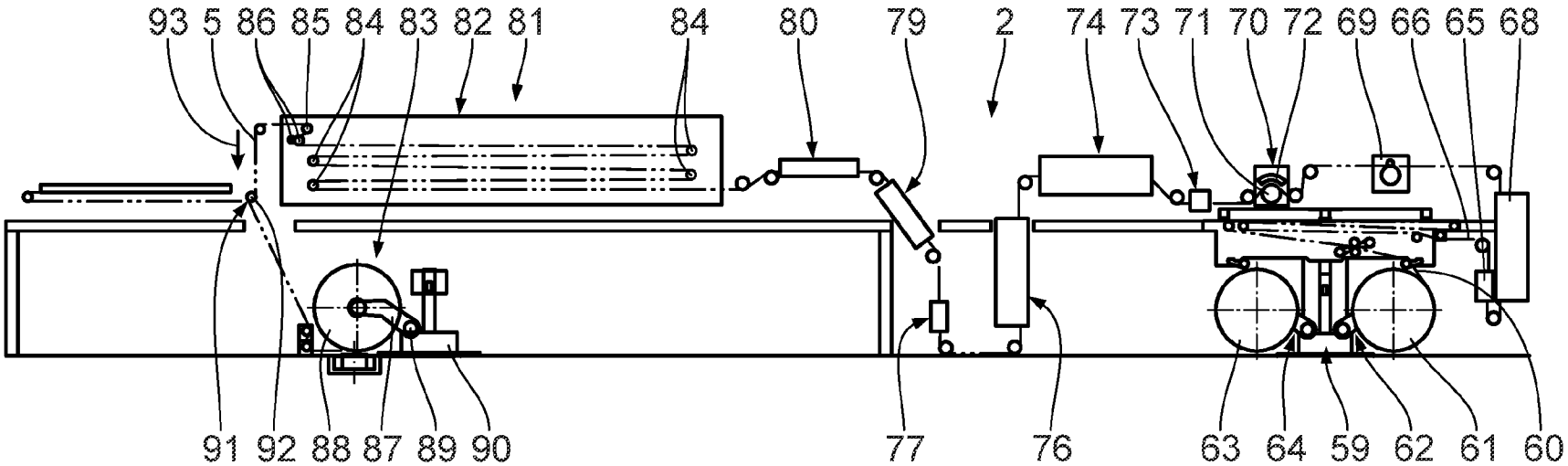
FIG. 3 shows a lateral view of the print-web printing line of the corrugated-board machine illustrated in FIG. 1.
Figure 3A:
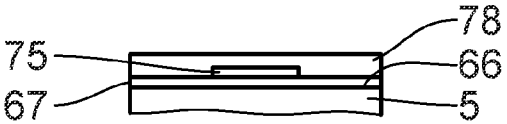
FIG. 3*a* shows a cross-section through a corrugated-board web including the print-web, which is manufactured by the corrugated-board machine illustrated in FIG. 1.
Figure 4:
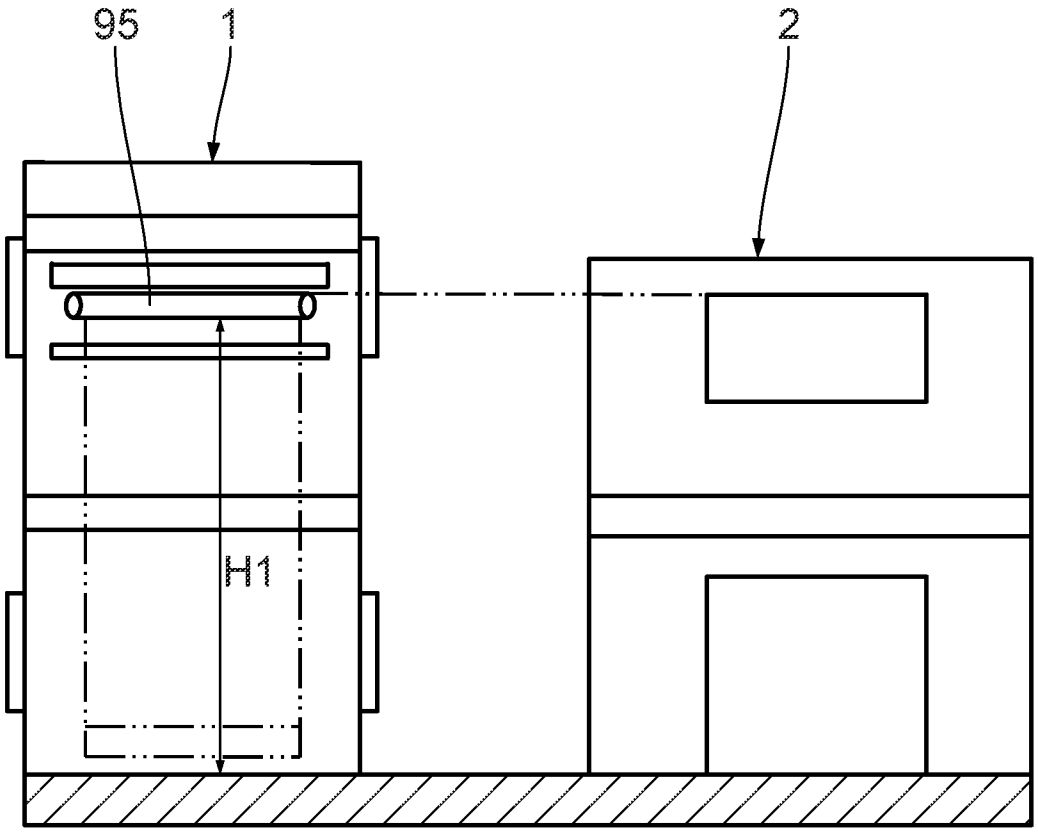
FIG. 4 shows a view of the corrugated-board machine shown in FIG. 1 perpendicular to the conveying direction of the corrugated-board web laminated on one side with the print-web transfer device, wherein the view illustrates transferring the print-web.

With reference to FIGS. 1 to 4, a corrugated-board machine comprises a corrugated-board manufacturing line 1, a print-web printing line 2 and a print-web transfer arrangement 3 by means of which the print-web printing line 2 is connected laterally to the corrugated-board manufacturing line 1. In the corrugated-board manufacturing line 1, an endless corrugated-board web 4 can be manufactured, while an endless, printed print-web 5 can be completed in the print-web printing line 2.

The corrugated-board manufacturing line 1 is oblong. It extends straight along in a corrugated-board manufacturing-line longitudinal direction 6. The print-web printing line 2 is also constituted to be oblong. It extends straight along in a printed-board printing-line longitudinal direction 7. The print-web printing line 2 extends parallel to the corrugated-board manufacturing line 1. The print-web printing line 2 and the corrugated-board manufacturing line 1 extend side-by-side. Perpendicular to their respective longitudinal direction 6 or respectively 7, they provide a spacing distance A from one another, which is generally disposed between 1 m and 10 m, by greater preference between 2 m and 5 m. The print-web printing line 2 accordingly extends laterally offset or respectively vertically offset from the corrugated-board manufacturing longitudinal direction 6, parallel to the corrugated-board manufacturing longitudinal direction 6.

The corrugated-board manufacturing line 1 comprises a device 8 for manufacturing an endless corrugated-board web 9 laminated on one side.

A cover-web splicing device 10 and a material-web splicing device 11 are arranged upstream of the arrangement 8 for manufacturing an endless corrugated-board web laminated on one side.

The cover-web splicing device 10 comprises a first unrolling unit 14 for the unrolling of an open-ended first cover-web 12 from a first cover-web roller 13 and a second unrolling unit 16 for the unrolling of an open-ended second cover-web from a second cover-web roller 15. The open-ended first cover-web 12 and second cover-web are connected to one another in order to provide an endless first cover-web 17 by means of a connecting and cutting unit of the cover-web splicing device 10, which is not illustrated.

The material-web splicing device 11 is constituted to correspond to the cover-web splicing device 10. This comprises a third unrolling unit 19 for the unrolling of an open-ended first material web 10 from a first material-web roller 18 and a fourth unrolling unit 22 for the unrolling of an open-ended second material web 20 from a second material-web roller 21. The open-ended first material web and second material web 20 are connected to one another in order to provide an endless material web 23 by means of a connecting and cutting unit 97 of the material web splicing device 11, which is not illustrated.

The endless cover-web 17 is supplied via a heating roller 24 and a first deflection roller 25 to the arrangement 8 for manufacturing an endless corrugated-board web 9 laminated on one side, while the endless material web 23 is supplied via a second deflection roller 26 to the arrangement 8 for manufacturing an endless corrugated-board web laminated on one side.

The device 8 for manufacturing an endless corrugated-board web 9 laminated on one side comprises, for the production of an endless corrugated web 27 comprising a corrugation from the endless material web 23, a first corrugating roller 28 mounted in a rotatable manner and a second corrugating roller 29 mounted in a rotatable manner. The corrugating rollers 28, 29 form a roller gap for the passage and corrugating of the endless material web 23. Together, they form a corrugating unit. The rotational axes of the two corrugating rollers 28, 29 extend parallel to one another.

For the connection of the endless corrugated web 27 to the first endless cover-web 17 to form a corrugated-board web 9 laminated on one side, the arrangement 8 for manufacturing an endless corrugated-board web 9 laminated on one side comprises a glue-application unit 30, which comprises a glue-dosage roller 31, a glue container (not illustrated) and a glue-application roller 32. For the passage and gluing of the endless corrugated web 27, the glue-application roller 32 forms a gap with the first corrugating roller 28. The glue disposed in the glue container is applied via the glue-application roller 32 to tips of the corrugation of the endless corrugated web 27. The glue-dosage roller 31 is disposed in contact with the glue-application roller 32 and serves for the formation of a uniform glue layer on the glue-application roller 32.

The endless cover-web 17 is then fitted together with the endless corrugated web 27 provided with glue from the glue container in the device 8 in order to manufacture an endless corrugated-board web 9 laminated on one side.

For the pressing of the endless cover-web 17 against the endless corrugated web 27 provided with glue, which, in turn, is in contact in regions with the first corrugating roller 28, the device 8 for manufacturing an endless corrugated-board web 9 has a pressing module 33. The pressing module 33 is favourably embodied as a pressing-belt module. It is arranged above the first corrugating roller 28. The pressing module 33 has two deflection rollers 34 and an endless pressing belt 35, which is guided around the two deflection rollers 34.

The first corrugating roller 28 engages in regions from below in a space present between the two deflection rollers 34, so that the pressing belt 35 is deflected by the first corrugating roller 28. The pressing belt 35 presses against the endless cover-web 17, which is pressed in turn against the endless corrugated web 27 provided with glue, in contact with the first corrugating roller 28.

For the intermediate storage and buffering of the endless corrugated-board web 9 laminated on one side, this is supplied via a vertical transport unit 36 to a storage unit 37, where the latter forms loops. The storage device 37 is carried by a base frame 39.

Furthermore, the corrugated-board manufacturing line 1 has a lamination-web splicing device 40, which comprises a fifth unrolling unit 43 for the unrolling of an open-ended first lamination-web 41 from a first lamination-web roller 42, and a sixth unrolling unit 45 for the unrolling of an open-ended second lamination-web from a second lamination-web roller 44. The first lamination-web 41 and the second lamination-web are connected to one another in order to provide an endless lamination-web 46 by means of a connecting and cutting unit 47 of the lamination-web splicing device 40. By means of the first splicing unit 47, the open-ended first lamination-web 41 and the open-ended second lamination-web can be spliced to one another or respectively to the endless lamination-web 46.

The lamination-web splicing device 40 ideally further comprises a second splicing unit 48. By means of the second splicing unit 48, the endless print-web 5 can be spliced to the endless lamination-web 46. By means of the second splicing unit 48, the endless print-web 5 can be spliced to the first lamination-web 41 or the second lamination-web.

With regard to the detailed structure and precise function of the lamination-web splicing device 40, reference is made to DE 10 2015 218 321.1.

A pre-heating device 49, which comprises two pre-heating rollers 50, 51 arranged one above the other, is disposed downstream of the storage unit 37 and the lamination-web splicing device 40. The corrugated-board web 9 laminated on one side and the endless lamination-web 46, which are both partially looped around the respective pre-heating roller 50, 51, are supplied to the pre-heating device 49.

Downstream of the pre-heating device 49, the corrugated-board manufacturing line 1 has a gluing unit 52 with a gluing roller 53, which is partially immersed in a glue bath. A glue-dosage roller 54 is in contact with the gluing roller 53 in order to form a uniform glue layer on the gluing roller 53. The endless corrugated-board web 9 laminated on one side is disposed in contact with its corrugated web 27 on the gluing roller 53, so that the corrugation of the corrugated web 27 is provided with glue from the glue bath.

Downstream of the gluing unit 52, the corrugated-board manufacturing line 1 has a hot-pressing device 55 (illustrated only in part), which comprises a horizontally extending heated table 56. An endless pressing belt 58 guided around guide rollers 57 is arranged adjacent to the heated table 56. Between the pressing belt 58 and the heated table 56, a pressing gap is constituted, through which the endless corrugated-board web 9 laminated on one side and the endless lamination-web 46 are guided with the formation of the endless corrugated-board web 4 laminated on both sides.

Downstream of the hot-pressing device 55, the corrugated-board manufacturing line 1 favourably has a longitudinal cutting/creasing device (not illustrated) for the longitudinal cutting and creasing of the endless corrugated-board web 4.

Downstream of the longitudinal cutting/creasing device, the corrugated-board manufacturing line 1 preferably has a transverse cutting device (not illustrated) for the transverse cutting of corrugated-board sub-webs (not illustrated), which have been produced by the longitudinal cutting/creasing device from the endless corrugated-board web 4.

A distributing guide (not illustrated) of the corrugated-board manufacturing line 1 is arranged downstream of the transverse cutting device, in order to convey the corrugated-board sub-webs to different levels.

Further transverse cutting devices (not illustrated) of the corrugated-board manufacturing line 1 for the transverse cutting of the corrugated-board sub-webs to form corrugated-board sheets are disposed downstream of the distributing guide.

The corrugated-board sheets are preferably stacked on one another in stacking devices (not illustrated) of the corrugated-board manufacturing line 1.

The print-web printing line 2 comprises a print-web splicing device 59, which, in turn, comprises a seventh unrolling unit 62 for the unrolling of an open-ended first print-web 60 from a first print-web roller 61, and an eighth unrolling unit 64 for the unrolling of an open-ended second print-web from a second print-web roller 63. The open-ended first print-web 60 and second print-web are connected to one another in order to provide the endless print-web 5 by means of a connecting and cutting unit of the print-web splicing device 59.

Downstream of the print-web splicing device 59, the print-web printing line 2 has a pre-coating application device 65 associated with the endless print-web 5, which applies a two-dimensional pre-coating 67 to an outer side 66 of the endless print-web 5. The two-dimensional pre-coating 67 covers, in particular, substantially the full surface of the endless print-web 5 on its outer side 66, which also forms an outer side on the finished corrugated-board web 4.

Downstream of the pre-coating application device 65, the print-web printing line 2 has a pre-coating drying device 68 associated with the endless print-web 5, which dries the endless print-web 5 provided on the outer side with the pre-coating 67 or respectively the pre-coating 67.

Downstream of the pre-coating drying device 68, the print-web printing line 2 has a drawing unit 69 associated with the endless print-web 5, which conveys the endless print-web 5 or respectively draws it away from the print-web splicing device 59.

Downstream of the drawing unit 69, the print-web printing line 2 has a corona pre-treatment device 70 associated with the endless print-web 50. The corona pre-treatment device 70 comprises a corona-bearing roller 71 and at least one electrode 72 arranged adjacent to the latter. The endless print-web 5 is guided around the corona-bearing roller 71. The endless print-web 5 in this context runs through a gap which is formed by the corona-bearing roller 71 and the at least one electrode 72. Through the corona pre-treatment device 70, the outer side 66 of the endless print-web 5 is exposed to an electrical corona discharge, which leads to an oxidation of its surface. This is implemented especially in the case of a coated, endless print-web 5. This results in higher dot gains in a colour application or respectively a printing. The adhesion of a printing colour on the endless print-web 5 is improved in this manner.

Downstream of the corona-pre-treatment device 70, the print-web printing line 2 has a cleaning device 73 associated with the endless print-web 5, which cleans the endless print-web 5 at least on the outer side.

Downstream of the cleaning device 73, the print-web printing line 2 has an inkjet printing device 74 associated with the endless print-web 5, which imprints at least one imprint 75 onto the outer side of the endless print-web 5 or respectively onto the dried pre-coating 67. The pre-coating 67 is accordingly disposed between the at least one imprint 75 and the print-web 5. The at least one imprint 75 is favourably a water-based colour imprint.

Downstream of the inkjet-printing device 74, the print-web printing line 2 has an inkjet-print drying device 76 associated with the endless print-web 5, which dries the printed, endless print-web 5 or respectively its at least one imprint 75.

Downstream of the inkjet-print drying device 76, the print-web printing line 2 has a varnishing unit 77 associated with the endless print-web 5 for the full-surface application of at least one transparent overcoating layer 78 to the outer side of the endless print-web. The at least one imprint 75 is accordingly disposed between the at least one overcoating layer 78 and the pre-coating 67. The at least one overcoating layer 78 covers the full surface of the at least one imprint 75 and is in direct contact with the latter. It is favourably formed by matt varnish, which is based on water and also designated as water varnish.

Downstream of the varnishing unit 77, the print-web printing line 2 has a varnish-drying device 79 associated with the endless print-web 5, which dries the varnished, endless print-web 5 or respectively its at least one overcoating layer 78.

Downstream of the varnish-drying device 79, the print-web printing line 2 has a back-moistening device 80 associated with the endless print-web, which moistens the endless print-web 5 at least on the outer side or respectively on the side to be glued to the corrugated-board web laminated on one side.

Furthermore, the print-web printing line 2 comprises a print-web storage device 81 for the storage particularly of the printed print-web 5. The print-web storage device 81 is arranged downstream of the back-moistening device 80.

In turn, the print-web storage device 81 comprises a dynamic print-web storage unit 82 and a print-web winding-on unit 83, which is disposed downstream of the dynamic print-web storage unit 82 with reference to a conveying direction 93 of the print-web 5.

Within the dynamic print-web storage unit 82, the print-web 5 is substantially guided around several deflection rollers 84 in a meandering manner. At least one of the deflection roller is 84 can be displaced perpendicular to its rotational axis, so that the length of the print-web 5 stored in the dynamic print-web storage unit 82 is dynamically variable. At the output side of the dynamic print-web storage unit 82, a withdrawing unit 85 is arranged, which comprises at least one withdrawing roller 86 for withdrawing the print-web 5 in the direction towards the print-web transfer arrangement 3.

The print-web winding-on unit 83 disposed downstream of the dynamic print-web storage unit 82 comprises a print-web winding-on roller 88 mounted in a rotatable manner in bearing arms 87 for winding on particularly the printed print-web 5. The bearing arms 87 can favourably be pivoted about a pivoting axis 89. The bearing arms 87 are mounted in a pivoted manner on a print-web winding-on frame 90. The print-web 5 must have passed through the dynamic print-web storage unit 82 so that the latter can be wound on in the print-web winding-on unit 83.

Between the dynamic print-web storage unit 82 and the print-web winding-on unit 83, a print-web distributing-guide arrangement 91 is arranged, which is able to guide the print-web 5 to the print-web winding-on unit 83 or past the print-web winding-on unit 83 to the print-web transfer arrangement 3. For this purpose, the print-web distributing-guide arrangement 91 favourably comprises at least one distributing-guide rail 92, which extends perpendicularly there, relative to the conveying direction 93 of the print-web 5. When the print-web 5 is guided to the print-web winding-on unit 83, the print-web 5 is deflected at the print-web distributing-guide arrangement 91 either not at all or respectively only slightly by the distributing-guide rail 92. By contrast, when the print-web 5 is guided to the print-web transfer arrangement 3, and the print-web winding-on unit 83 is bypassed, the endless print-web 5 is deflected by approximately 90° at the print-web distributing-guide arrangement 91.

Downstream of the print-web distributing-guide arrangement 91, the print-web transfer arrangement 3 is arranged, which comprises a first reflection rail 94 and a second deflection rail 95.

The first deflection rail 94 is arranged adjacent to the print-web distributing-guide arrangement 91. This extends horizontally and encloses with the conveying direction 93 of the print-web 5 present there an angle w1, of 45°. At the first deflection rail 94, the print-web 5 is deflected by 90° and turned through 180°. The print-web 5 accordingly runs in the print-web transfer arrangement 3 perpendicular to the longitudinal direction 7 of the print-web printing line or respectively to the longitudinal direction 6 of the corrugated-board manufacturing line. The first deflection rail 94 is arranged on the base frame 39.

The second deflection rail 95 extends parallel to the first deflection rail 94. The second deflection rail 95 is disposed within the corrugated-board manufacturing line 1. The print-web 5 is deflected through 90° by the second deflection rail 95 in the direction towards the corrugated-board manufacturing longitudinal direction 6 and turned through 180°. The print-web 5 is conveyed downstream to the second deflection rail 95 in the direction of the conveying direction 96 of the adjacent, endless corrugated-board web 9 laminated on one side.

The second deflection rail 95 is arranged on the base frame 39. It is arranged adjacent to the storage device 37.

The two deflection rails 94, 95 are disposed in a common horizontal plane. They are arranged at a substantially identical vertical height H1, relative to a substructure above the connecting and cutting unit 97 of the material-web splicing device 11.

Figure 5:
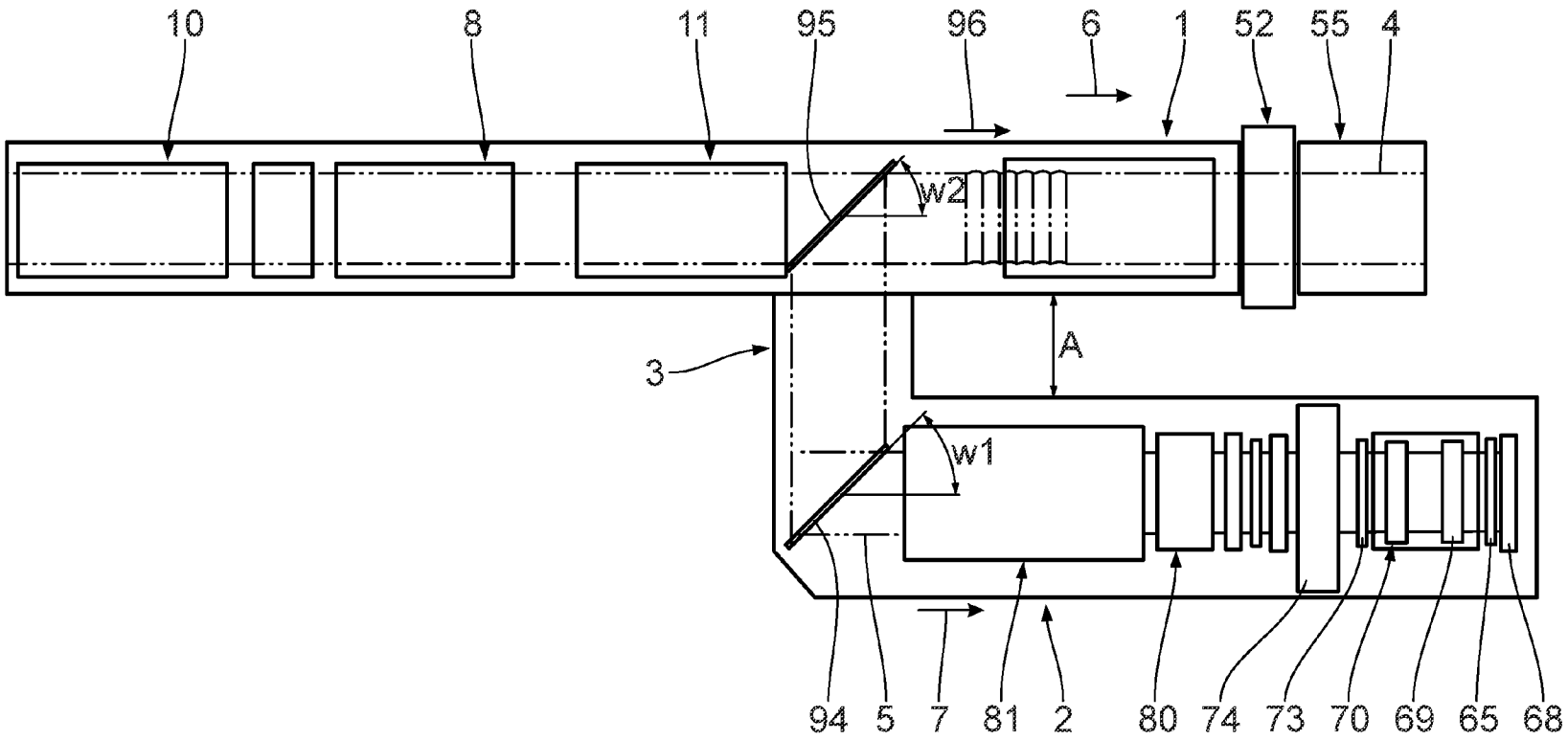
FIG. 5 shows a schematic plan view of a part of a corrugated-board machine according to the invention in a second embodiment.
Figure 6:
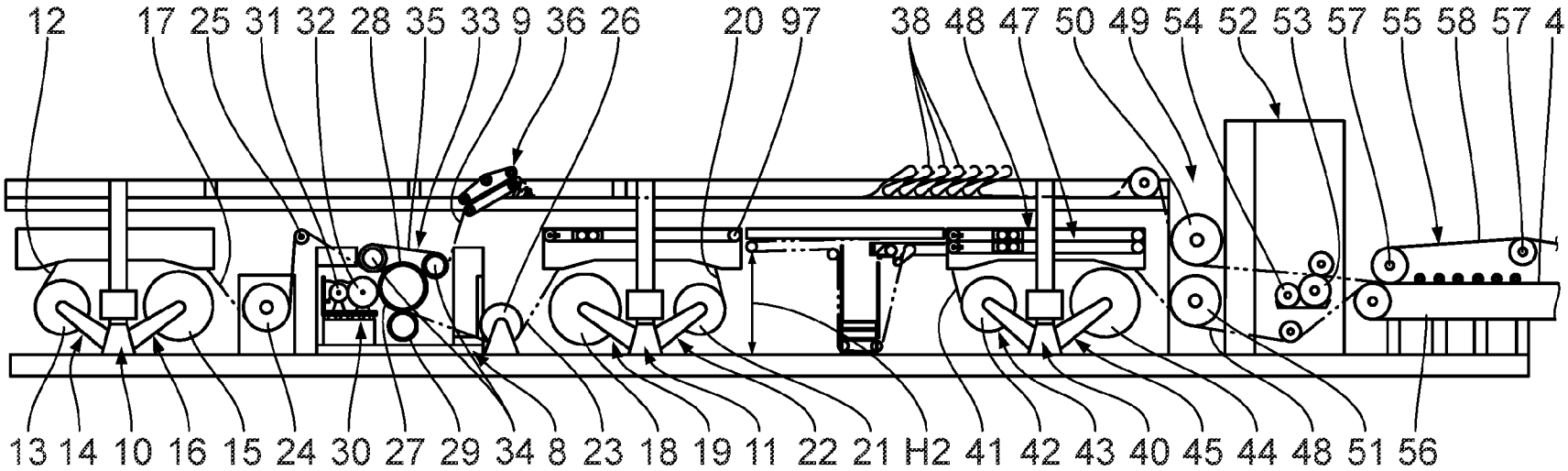
FIG. 6 shows a lateral view of the corrugated-board manufacturing line of the corrugated-board machine illustrated in FIG. 5.
Figure 7:
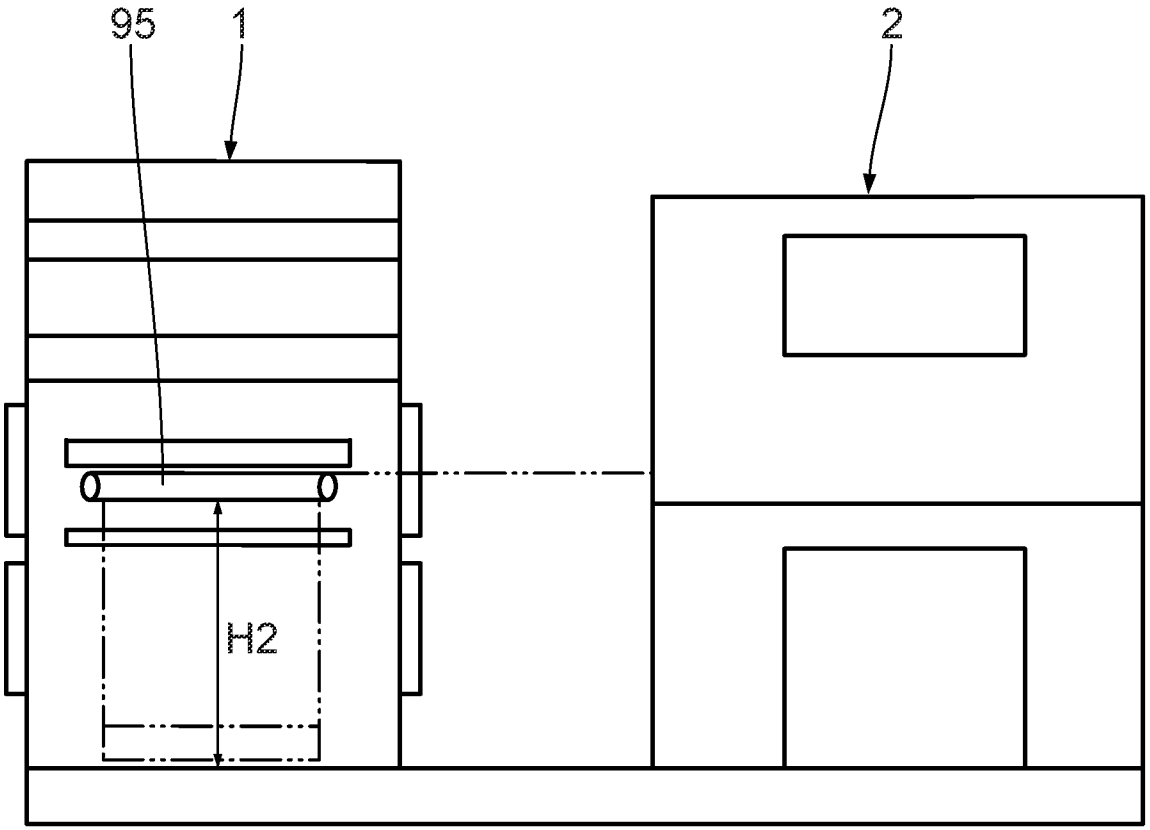
FIG. 7 shows a view of the corrugated-board machine illustrated in FIG. 5 corresponding to that of FIG. 4.

In the following, a second embodiment is described with reference to FIGS. 5 to 7. By contrast with the previous embodiment, to which reference is made, the deflection rails 94, 95 are arranged lower at a vertical height H2 relative to the substructure. They are disposed at the height of the splicing units 47, 48 of the lamination-web splicing device 40. Otherwise, there are no substantial differences.

What is claimed is:

1. A corrugated-board machine, comprising:

a print-web printing line for manufacturing a printed print-web, the print-web printing line comprising a print-web unrolling device for unrolling a print-web to be printed, and a printing device for printing the print-web;

a corrugated-board manufacturing line for manufacturing a corrugated-board web, the corrugated-board manufacturing line comprising a cover-web unrolling device for unrolling a cover-web, a material-web unrolling device for unrolling a material-web to be corrugated, a device for manufacturing a corrugated-board web laminated on one side made from the cover-web and the material web, a lamination-web unrolling device for unrolling a lamination-web, and a gluing-unit for applying glue to the corrugated-board web laminated on one side; and a print-web transfer arrangement disposed downstream of the print-web printing line and adjoining the corrugated-board manufacturing line for transferring the print-web to the corrugated-board manufacturing line and using as a laminated web, the print-web printing line and the corrugated-board manufacturing line extending at least in regions parallel and laterally offset relative to one another.

2. A corrugated-board machine according to claim 1, wherein the print-web printing line conveys the print-web in contrary motion to the corrugated-board web laminated on one side and conveyed adjacently in the corrugated-board manufacturing line.

3. A corrugated-board machine according to claim 1, wherein the corrugated-board manufacturing line comprises, downstream from the device for manufacturing a corrugated-board web laminated on one side, a storage device for storing the corrugated-board web laminated on one side.

4. A corrugated-board machine according to claim 3, wherein the print-web transfer arrangement is connected adjacent to the storage device to the corrugated-board manufacturing line.

5. A corrugated-board machine according to claim 1, wherein the print-web transfer arrangement is connected above the material-web unrolling device to the corrugated-board manufacturing line.

6. A corrugated-board machine according to claim 1, wherein the print-web transfer arrangement is connected at approximately a vertical height of a connecting and cutting unit of the material-web unrolling device to the corrugated-board manufacturing line.

7. A corrugated-board machine according to claim 1, wherein the print-web transfer arrangement extends at least in regions substantially perpendicular to at least one of the corrugated-board manufacturing line and the print-web printing line.

8. A corrugated-board machine according to claim 1, wherein the print-web transfer arrangement comprises a deflection arrangement for deflecting the print-web from its conveying direction into a conveying direction of the corrugated-board web at the print-web transfer arrangement.

9. A corrugated-board machine according to claim 8, wherein the deflection arrangement deflects the print-web through substantially 180°.

10. A corrugated-board machine according to claim 1, wherein the print-web printing line comprises, downstream of the printing device, a print-web storage device for storing the print-web.

11. A corrugated-board machine according to claim 10, wherein the print-web storage device comprises a print-web winding-on unit for winding on the print-web.

12. A corrugated-board machine according to claim 11, wherein a print-web distributing-guide arrangement for guiding the print-web to one of the print-web winding-on unit and the corrugated-board manufacturing line is arranged between the print-web winding on unit and the dynamic print-web storage unit.

13. A corrugated-board machine according to claim 10, wherein the print-web storage device comprises a dynamic print-web storage unit for storing the print-web.

14. A corrugated-board machine according to claim 1, wherein the lamination-web unrolling device comprises a multiple-splicing device, which comprises a first splicing unit for splicing a first laminated web and a second laminated web to one another and a second splicing unit for splicing the print-web to one of the first laminated web and the second laminated web.

15. A corrugated-board machine according to claim 14, wherein the print-web printing line is connected upstream of the lamination-web unrolling device to the lamination-web unrolling device for transferring the print-web to the lamination-web unrolling device.

16. A corrugated-board machine, comprising:

a print-web printing line for manufacturing a printed print-web, the print-web printing line comprising a print-web unrolling device for unrolling a print-web to be printed, and a printing device for printing the print-web;

a corrugated-board manufacturing line for manufacturing a corrugated-board web, the corrugated-board manufacturing line comprising a cover-web unrolling device for unrolling a cover-web, a material-web unrolling device for unrolling a material-web to be corrugated, a device for manufacturing a corrugated-board web laminated on one side made from the cover-web and the material web, a lamination-web unrolling device for unrolling a lamination-web, and a gluing-unit for applying glue to the corrugated-board web laminated on one side; and a print-web transfer arrangement disposed downstream of the print-web printing line and adjoining the corrugated-board manufacturing line for transferring the print-web to the corrugated-board manufacturing line and using as a laminated web, the print-web printing line comprising, downstream of the printing device, a print-web storage device for storing the print-web.

17. A corrugated-board machine according to claim 16, wherein the print-web storage device comprises a print-web winding-on unit for winding on the print-web.

18. A corrugated-board machine according to claim 17, wherein a print-web distributing-guide arrangement for guiding the print-web to one of the print-web winding-on unit and the corrugated-board manufacturing line is arranged between the print-web winding on unit and the dynamic print-web storage unit.

19. A corrugated-board machine according to claim 16, wherein the print-web storage device comprises a dynamic print-web storage unit for storing the print-web.

20. A corrugated-board machine, comprising:

a print-web printing line for manufacturing a printed print-web, the print-web printing line comprising a print-web unrolling device for unrolling a print-web to be printed, and a printing device for printing the print-web;

a corrugated-board manufacturing line for manufacturing a corrugated-board web, the corrugated-board manufacturing line comprising a cover-web unrolling device for unrolling a cover-web, a material-web unrolling device for unrolling a material-web to be corrugated, a device for manufacturing a corrugated-board web laminated on one side made from the cover-web and the material web, a lamination-web unrolling device for unrolling a lamination-web, and a gluing-unit for applying glue to the corrugated-board web laminated on one side; and a print-web transfer arrangement disposed downstream of the print-web printing line and adjoining the corrugated-board manufacturing line for transferring the print-web to the corrugated-board manufacturing line and using as a laminated web, the lamination-web unrolling device comprising a multiple-splicing device, which comprises a first splicing unit for splicing a first laminated web and a second laminated web to one another and a second splicing unit for splicing the print-web to one of the first laminated web and the second laminated web.

* * * * *